US008887327B2

(12) United States Patent
Davis, Jr.

(10) Patent No.: US 8,887,327 B2
(45) Date of Patent: Nov. 18, 2014

(54) FOLDING APPARATUS FOR TRANSFERRING A PATIENT

(71) Applicant: ACE Safety Gear, LLC, Medina, OH (US)

(72) Inventor: Calvin Paul Davis, Jr., Medina, OH (US)

(73) Assignee: ACE Safety Gear, LLC, Medina, OH (US)

( * ) Notice: Subject to any disclaimer, the term of this patent is extended or adjusted under 35 U.S.C. 154(b) by 0 days.

(21) Appl. No.: 13/743,325

(22) Filed: Jan. 16, 2013

(65) Prior Publication Data

US 2013/0180046 A1 Jul. 18, 2013

Related U.S. Application Data

(60) Provisional application No. 61/587,075, filed on Jan. 16, 2012.

(51) Int. Cl.
*A61G 1/003* (2006.01)
*A61G 7/10* (2006.01)

(52) U.S. Cl.
CPC ..... *A61G 7/1026* (2013.01); *A61G 7/1074* (2013.01)
USPC ..... 5/81.1 HS; 5/653; 5/632; 5/420

(58) Field of Classification Search
CPC ... A61G 7/1026; A61G 7/103; A61G 7/1057; A45F 3/02; A45F 3/04; A45F 2003/003; A45F 2003/00246
USPC ..... 5/653, 632, 81.1 HS, 420; 24/462, 545, 24/546, 457, 570
See application file for complete search history.

(56) References Cited

U.S. PATENT DOCUMENTS

| | | | | |
|---|---|---|---|---|
| 3,323,151 | A * | 6/1967 | Lerman | 5/722 |
| 3,336,610 | A * | 8/1967 | Geddings | 5/420 |
| 3,489,194 | A * | 1/1970 | Hoover | 383/4 |
| D274,493 | S * | 7/1984 | Dyby | D6/392 |
| 6,618,883 | B2 * | 9/2003 | Angland | 5/659 |
| 7,065,814 | B2 * | 6/2006 | Rutkowski | 5/655 |
| D685,593 | S * | 7/2013 | Boyer | D6/592 |
| 2006/0282946 | A1 * | 12/2006 | Meyer | 5/81.1 HS |

* cited by examiner

*Primary Examiner* — William Kelleher
*Assistant Examiner* — Duoni Pan
(74) *Attorney, Agent, or Firm* — Buckingham, Doolittle & Burroughs, LLC

(57) ABSTRACT

The invention involves a folding patient transfer apparatus with a material top layer and a material bottom layer. A plurality of inserts has handhold openings that are formed in the inserts that are positioned between the material top layer and the material bottom layer utilizing a sewn plurality of insert seams. The seams form enclosed material chambers containing the inserts. The materials can be disposed of due to contamination; however the inserts can be sterilized reducing hospital waste and cost. The apparatus is configured to slide and/or lift and/or carry a patient from a non-planer surface to a second planer or non-planer surface.

3 Claims, 10 Drawing Sheets

FOLDING APPARATUS FOR TRANSFERRING A PATIENT

FIELD OF THE INVENTION

The invention relates generally to an apparatus for easily and safely transferring a patient from one surface to another and more specifically to a folding multi-panel patient transfer apparatus, where the apparatus is assembled, designed, manufactured and assembled with multiple panels and fabric hinges.

BACKGROUND OF THE INVENTION

The present invention relates to an articulating patient transfer apparatus and method for using same, for transferring a person from one surface to another surface whether both surfaces are relatively flat/planar or not. Although the prior art teaches many devices to aid in moving a person between two different flat surfaces of equal height, such as between a bed and a medical examination table, all of these teachings demonstrate limitations that the present invention addresses and overcomes.

The need to transfer a patient, person or animal that is unable to move completely under its own power is a common occurrence in the medical and veterinary professions. Typical scenarios include: ambulance personnel needing to move a semi-reclined patient from a transport cot to a flat hospital bed, the need to move a patient from a gurney to an x-ray table, and a nursing home resident needing to be moved from a bed to a wheelchair. Traditionally, these transfers require a multitude of care givers and a sheet in addition to some form of transfer device such as a slide board or a mechanical lifting device. However, it is still very common to encounter situations where there are an insufficient number of caregiver personnel to affect a safe transfer, both for the patient and/or the caregivers. Many medical facilities have limited staff, ambulance crews may only have two rescuers, and home healthcare aids may be completely on their own yet still must move patients despite the difficulties and risks.

Transferring patients between beds and other surfaces is a significant cause of musculoskeletal injury among caregivers. Despite the numerous devices that exist to facilitate these transfers, many caregivers still resort to simply physically lifting the patient between the surfaces because of cost, convenience, or lack of training. Back and shoulder injuries to the healthcare providers occur because the patient transfer causes the caregiver to become off balance and twist their own body in order to move the patient. In addition, many patients cannot move under their own power or are obese which further increases the risk of injury to the caregivers. The cost of these injuries to caregivers is significant, but may also create additional patients that now may require transfer themselves.

In addition to the injuries to caregivers, there is a risk of injury or additional pain to the patient from the jerking movements that are common during patient transfers. If a patient has a broken bone or other injuries, any disruptive movement can complicate the injury or recovery. The transfer process may cause new injuries such as skin tears, abrasions, friction burns, and joint injury. Also, intravenous lines, feeding tubes or other monitoring wires often become dislodged or damaged during many patient transfers.

Many devices exist to help address these problems. However, most are designed for clinical hospital settings such as for transfer from a flat gurney to a flat x-ray table. In addition, most of the existing transfer devices are only designed for sliding a patient between two supporting surfaces and cannot hold a patient's weight by themselves which limits usefulness. Typically, a patient must be rolled onto his side and have a sheet placed under him, have the device slid under the sheet, and then have the sheet and patient pulled across the piece of equipment by several caregivers. These types of devices may or may not work well in these limited situations, however these devices do not address many other common scenarios such as where a patient must be lifted in addition to being transferred, the patient or the surface is not completely flat, or the number or physical ability of the caregivers to affect a safe patient transfer is limited. For example, emergency medical and out of hospital caregivers frequently encounter situations where a patient must be moved several times with different devices or techniques, such as a move off of the floor to a cot and then from a cot to a hospital examination table.

While some existing devices are somewhat flexible, most still do not conform very well to a non-supine body. They can over flex causing a patient to slide off of the board prematurely. Another problem is that they require a storage space that is the same size as the device. These shortcomings have led to most healthcare providers defaulting to the "sheet method" of simply picking up a patient by the sheet upon which they rest and then lifting or sliding the sheet to the new location. Unfortunately, the lack of rigidity in the sheet, lack of grasping handles, and the potential for the sheet to rip or tear can lead to the same problems that exist with other current transfer devices.

An example of a prior art device that helps move a patient between flat surfaces is described in U.S. Publication 2008/0155746 to Neumeyer. This device is described as a rigid plastic slide board that is used to move patients between two support structures such as between a bed and a cot. The device is positioned under the patient who is then slid across the surface of the board onto the next surface while decreasing the likelihood of injury to the caregiver. However, this invention would not permit the safe transfer of a patient that was not in a supine position. The device is flexible to allow for slightly elevating a patient's head or legs, but the entire device could slope creating an uncomfortable surface on which the patient could accidently slide or fall off. Also, the flexed device would not allow for proper support of a patient with bent knees without additional padding such as pillows, and would not flex nearly enough to move a patient safely from or to a seated or upright position such as sitting up in bed. In addition, the device is specifically designed not to bear a patient's weight further limiting its usefulness, for example, if a patient needs to be moved off of a floor to a bed.

Another prior art patient transfer device, U.S. Pat. No. 4,744,115 to Marchione teaches a planar device with two rigid panels for moving a patient between two supporting surfaces. This device purports to accomplish the common objective of most slide boards, moving the patient between two surfaces, with the added benefit of folding in the middle for easier storage. While this may allow movement between a semi-reclined surface and a flat surface, it does not permit support of a patient with bent knees or other positions with more than a single bend only in the middle of the device. Another problem that this device does not solve is the patient that needs to be first lifted off of one surface before transfer between other surfaces of equal height.

U.S. Pat. No. 4,700,416 to Johansson describes a patient transfer mat with a body portion and two folding wing sections. This device is designed to fold for compact storage and conform to the curves of a human body. However, this device is substantially smaller than a human body and requires multiple devices to affect the transfer. In addition, use is complicated in that more than one device must be placed all of the way under a patient and then the patient is strapped in place. Next both devices must be pulled at the same rate across the surfaces or there will be torque placed on the patient's spine. Additionally, as the device is less than one half of the size of a body, it may not be used to lift a patient at all.

Therefore, a need remains for a patient transfer device that is safe to use for the patient and the caregiver that can conform to the wide variety of situations that occur necessitating the transfer of a patient. More specifically, a need still exists for a multi-panel foldable patient transfer apparatus that can adapt to a non-supine patient or a non-flat surface and can affect a patient transfer with a minimum of caregivers and can bear the patient's weight as needed, and method of the same.

SUMMARY OF THE INVENTION

Accordingly, the present invention overcomes the limitations of the prior art by providing a unique and useful foldable patient transfer apparatus with articulating sections that makes it easy to move a person or other heavy object between two surfaces that need not be completely flat or at the same height.

Consequently, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

It is an object of the present invention to provide an improved patient transfer apparatus that better conforms to the human body and provides support along more than one plane that may be used to slide a person between two surfaces of equal or unequal height or where the surfaces are not flat.

It is a further object of this invention to present a patient transfer apparatus that is simple to construct and folds to approximately of quarter of its fully deployed length for easy and convenient storage.

It is yet a further object of apparatus where the portability of the apparatus lends itself to ambulance crew applications.

It is an object of the present invention to provide a patient transfer apparatus that is capable of independently supporting the weight of a human body.

It is an object of the present invention to provide a patient transfer apparatus that allows for the transfer of a patient from a seated position to a supine position and vice versa.

It is yet a further object of the present invention to provide a patient transfer apparatus that is impervious to water, blood, contaminants and other body fluids.

It is another object of the present invention that in a patient transfer apparatus that is has a low coefficient of friction on one or both outer surfaces.

It is an additional object of the invention to provide an apparatus for transferring a patient with easy to grasp and secure handholds.

It is an additional object of the invention to provide an apparatus for transferring a patient wherein the apparatus is radiolucent and may remain in place during common diagnostic tests such as x-rays, Computerized Axial Tomography (CAT) scans, and Magnetic Resonance Imaging (MRI) scans.

It is yet a further object of the present invention to provide an apparatus for moving a patient with a plurality of hinges capable of articulating up to or about 360 degrees.

It is yet another object of this invention to provide an apparatus for lifting or sliding a patient with straps for securing the patient to the apparatus.

It is another embodiment of the present invention to provide a patient transfer apparatus for use in a wide variety of emergency, acute care, long term care, rehabilitative care, home health care settings, and the like.

It is another embodiment of the present invention to provide an apparatus that allows a single person to move cadavers of deceased humans or animals.

It is yet another object of this invention to provide an apparatus useful for moving humans or animals across two surfaces.

It is an additional object of the invention to provide a method of transferring a patient between two surfaces where at least one of the surfaces is not flat or requires the apparatus to be articulated to provide support to an elevated or bent portion of the body.

It is an object of the present invention to provide an apparatus for containing contaminants and keeping them away from caregivers.

It is yet a further object of the present invention to provide a patient apparatus that utilizes multiple covers that can be placed over the inserts.

It is an object of the present invention to provide an apparatus that folds to approximately one quarter of its fully deployed length It is yet a further object of the present invention to provide a patient apparatus that utilize multiple covers so that if a patient is allergic to one material covering, an alternate cover material can be used.

It is another object of the present invention that in an apparatus can be made compliant in different states may have different regulations that regulate the material used for the apparatus.

It is an additional object of the invention to provide an apparatus where a top surface has a lower coefficient of friction than a bottom surface of the apparatus utilizing different materials on the top and the bottom surfaces.

It is an object of the present invention to provide an apparatus that minimizes waste if the outer material is damaged or contaminated by cleaning the inserts and inserting them into a new cover.

It is a further object of this invention to present a patient an apparatus where inserts can be removed from a cover and placed in a dishwasher for cleaning.

It is another object of the present invention an apparatus that can reduce hospital waste thereby reducing what hospitals are charged, which is based on the weight of biohazard material they discard.

It is an additional object of the invention is to provide an apparatus where the ability to store the apparatus in a closed cabinet thereby increasing cleanliness and organization.

It is another object of the invention is to provide an apparatus to selectively be a single patient use for a patient with a contagious or infectious disease, where the outer material can be discarded and rigid inserts recycled.

BRIEF DESCRIPTION OF THE DRAWINGS

Embodiments of the invention will now be described with reference to the accompanying drawings

DETAILED DESCRIPTION OF THE INVENTION

Figure 11:
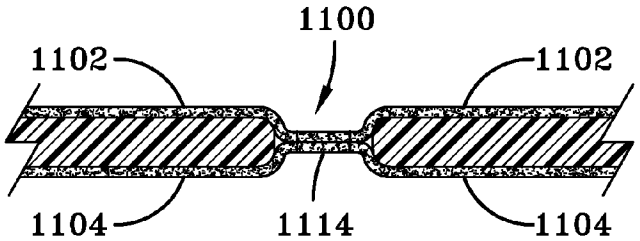
FIG. 11 illustrates a sectional view of a material hinge as a part of a folding patient transfer apparatus according to one embodiment of the invention.

One or more implementations of the present invention will now be described with reference to the attached drawings, wherein like reference numerals are used to refer to like elements throughout. The invention relates generally to a light weight and simplified patient transfer apparatus for moving a person from one surface to another surface, and a method of moving a patient between two uneven surfaces using the same. Although the invention is described with respect to transferring humans it would apply equally to other animals, for example, dogs, dolphins and the like as well as objects such as furniture, tires, non-animals, etc.

Figure 1:
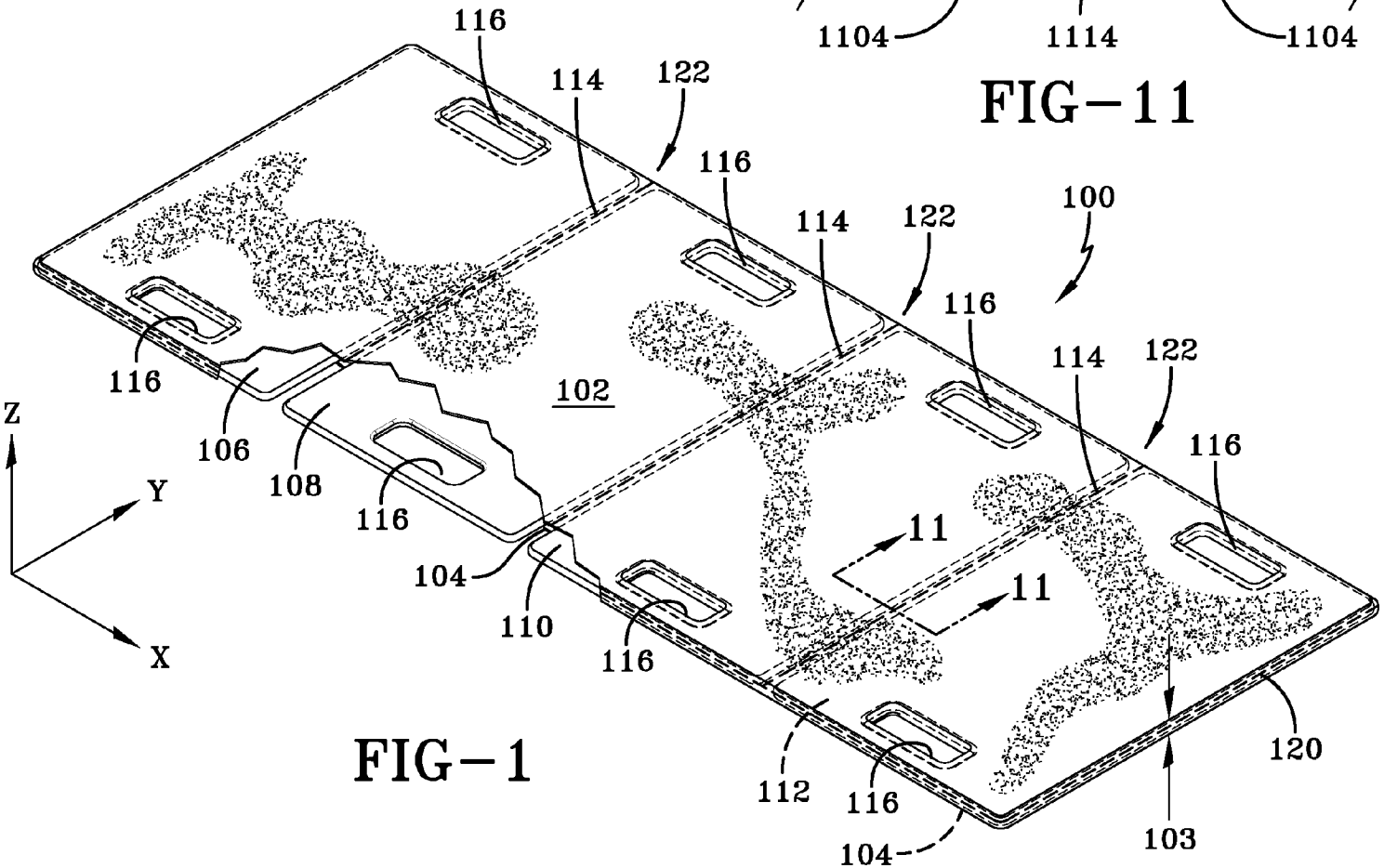
FIG. 1 illustrates a perspective view of a folding patient transfer apparatus on a flat surface according to one embodiment of the invention.

Referring initially to FIG. 1, a top perspective view of a folding patient transfer apparatus 100 is illustrated according to one embodiment of the invention resting on a flat surface. The folding patient transfer apparatus 100 comprises a material top layer 102, a material bottom layer 104, a plurality of substantially rectangular rigid inserts 106, 108, 110 and 112 (with rounded corners) and a plurality of handhold openings 116. The folding patient transfer apparatus 100 is preferably large enough to accommodate an average sized adult person with a preferred length of between 48 and 96 inches and a preferred width of between 20 and 30 inches. However, the inventor also recognizes variations of the folding patient transfer apparatus 100 properly sized for smaller pediatric patients and for larger or obese patients and/or animals. A thickness 103 of the folding patient transfer apparatus 100 comprises ranges from between ⅛ and ⅞ inches with a preferred thickness of between ¼ and ⅝ inches. However, the thickness 103 of the folding patient transfer apparatus 100 can comprise a thickness greater than ⅝ths of an inch. In addition, the long edges of inserts can be manufactured to slope downward to form a ramp to avoid rolling the patient onto sharp corners and other techniques known by one of skill in the art.

The top layer 102 and the bottom layer 104 can be joined together along the perimeter of the folding patient transfer apparatus 100 with a perimeter seam(s) 120 that encapsulates the plurality of substantially rectangular rigid inserts 106, 108, 110, and 112 forming a unitary apparatus 100 capable of use as a sliding device and as a lifting and carrying device. Although the inserts are described as substantially rectangular rigid inserts, the inserts can take any shape known by those of skill in the art. Also, the inserts are described as rigid, however the inserts can comprise adjustable stiffness, be inflatable, etc. Further, both the material top layer 102 and the material bottom layer 104 both have an inner surface (not shown). The inner surface of the top layer 102 faces the inner surface of the bottom surface 104 and in some locations the top layer 102 and the bottom layer 104 are joined together (e.g., seams).

The material top layer 102 and the material bottom layer 104 can comprise polytetrafluoroethylene (PTFE) coated vinyl, nylon, polyethen, personal protective equipment (PPE), or a combination thereof. However the material top layer 102 and bottom layer 104 can comprise any material and/or fabric known by those of skill in the art. Numerous fabric materials in and of themselves have been developed which demonstrate desirable properties, such as fluid penetration resistant to reduce the likelihood of transporting microbes, bodily fluids and the like between patients, family members and health care professionals. These material top and bottom layers 102 and 104 further allow the folding patient transfer apparatus 100 to comprise properties of substantially water proof, impervious to body fluids, antimicrobial, antibiotic, antistatic, latex free and scratch resistant properties. A further benefit of these materials comprises the ease in which it can be cleaned or decontaminated after use, to have radiolucent properties. In other words, the material top and bottom layers 102 and 104 comprise properties that will not interfere with known diagnostic tests such as x-rays, CAT scans, MRI tests, and the like, known by one of skill in the art. However, versions of the top layer 102 and the bottom layer 104 material may also comprise vinyl with or without a low friction coating, polyethylene, plastic, polymers, nylon, rubber, polypropylene, and the like or combinations thereof, or any other material or fabric known to one of skill in the art. Additionally, it is desirable that the top layer 102 outer surface to have a low coefficient of friction for greater ease sliding the patient onto the apparatus. The inner surfaces of the top layer 102 and of the bottom layer 104 material need not be of the same material or have a low coefficient of friction coating. It is desirable for the material bottom layer 104 outer surface have a higher coefficient of friction coating to increase friction and reduce sliding.

The plurality substantially rectangular rigid inserts 106, 108, 110 and 112 are sandwiched or positioned between the material top layer 102 and the material bottom layer 104. The preferred embodiment comprises four of the substantially rectangular rigid inserts 106, 108, 110 and 112 of substantially the same dimensions aligned along the x axis of the folding patient transfer apparatus 100. The plurality of rigid inserts 106, 108, 110 and 112 materials can comprise polyvinyl chloride (PVC), vinyl, polyethylene, polypropylene, plastic materials, polymers, wood, metal, thermoplastics, composite materials, acetyl materials, resins, laminates, and the like. These materials provide a combination of rigidity, strength, and flexibility that allow the folding patient transfer apparatus 100 to have a variety of uses.

The preferred embodiment utilizes four rigid inserts 106, 108, 110 and 112 that are substantially 18 inches long, 24 inches wide with a thickness of between ⅛ and ⅜ inches. However, this is not meant as a limitation, a wide variety of different sizes, shapes, and a different number of the rigid inserts are also contemplated by the inventor (e.g., 3 or greater inserts). In addition, rigid inserts used in a folding patient transfer apparatus may all be identical or of different sizes and shapes as known by those of skill in the art.

The plurality of inserts 106, 108,110 and 112 are held or fixed in position in a plurality of chambers 122 formed by a plurality of insert seam hinges 114 that form an inner separation between each of the rigid inserts 106, 108, 110 and 112. The insert seams 114, and the perimeter seam(s) 120 constructed utilizing techniques comprising RF welding, ultrasonic welding, heat sealing, stitching, the use of glue or other known adhesives, and the like, or by any other method of joining similar materials known to one of skill in the art. The insert seams 114 between adjacent rigid inserts form a plurality of hinges 111 in the y axis direction comprising the attached material top and bottom layers 102, 104. Therefore, the patient transfer apparatus 100 as shown in FIG. 1 comprises three such hinges 111. However, the numbers of hinges contemplated by the inventor(s) directly correlate to the number of inserts selected and other variations known by one of skill in the art. The hinges 111 articulate substantially 180 degrees in either direction around the y axis. This articulation permits the patient transfer apparatus 100 to form a variety of shapes ranging from fully folded along each of the hinges 111 so that the device is substantially one-quarter of the total unfolded length in one plane and the same width. The hinges 111 may be positioned so that the patient transfer apparatus 100 may be placed at any degree of recline in relation to the inserts 106, 108,110 and 112 so that a patient may be moved from any position from supine to sitting upright at 90 degrees. For example, if a patient is lying flat but with knees bent, the folding patient transfer apparatus 100 could have only one hinge 111 (FIG. 1) elevated off of a surface to conform to the bent knees of the patient while the other inserts 108, 110 and 112 are lying flat in the x-y plane.

The patient transfer apparatus 100 may be manufactured in parts for later combination. Each of the rigid inserts 106, 108, 110 and 112 for example may be cut individually from a piece of stock material into the proper size. The rigid inserts 106, 108 may then be positioned on top of the bottom layer 104 after an adhesive is optionally placed on each side of the rigid inserts 106, 108, 110 and 112. The material top layer 102 and bottom layer 104 can be joined together at an outside edge of the inserts 106, 110 that are furthest apart with widthwise perimeter seams 120 and the inserts can be captured in the direction of the y axis with lengthwise perimeter seams 122. The hand hold openings 116 can be manufactured utilizing techniques known by one of skill in the art. The hand hold openings 116 can be cut or die stamped, for example through the inserts 106, 108,110 and 112 and layers 102 and 104 cut out and sealed utilizing techniques mentioned previously. In this embodiment 100, all of the inserts 106, 108,110 and 112 are permanently captured between the layers 102 and 104. However, the inventors contemplate that if the layers 102 and/or 104 get damaged or exposed to a contagious patient, for example they can be removed and the inserts can be sent back to the manufacturer for cleaning, sanitizing and reusing them in a new apparatus. In this way, the invention provides an apparatus that minimizes waste if the outer material is damaged or contaminated by cleaning the inserts and inserting them into a new cover. This results in reduced hospital costs and waste, for example, by reducing what hospitals are charged, which is based on the weight of biohazard material they discard.

Finally, the patient transfer apparatus 100 may be optionally utilize heat shrink material so that when exposed to a heating device the layer 102 and 104 would heat shrink and better hold the rigid inserts 106, 108, 110 and 112 in place between the top layer 102 and the bottom layer 104. The inventor recognizes other methods of manufacture such as vacuum sealing, adhesives, stitching, and the like, as well, known by those of skill in the art.

As discussed supra, the patient transfer apparatus 100 may have any number of properties comprising the number of rigid, flexible and varying thickness inserts. The inventor contemplates another embodiment where the rigid inserts 106, 108, 110 and 112 and are made of different materials, comprising, composites, metal, plastics, and other materials well known by those of skill in the art. Increasing a number of rigid inserts in a patient transfer apparatus increases the number of the hinges correspondingly. A greater number of the hinges may allow a user to roll up the patient transfer apparatus for storage into a more compact size than one quarter of its length, mentioned supra. Additionally, a patient transfer apparatus with additional hinges would be more adaptable to the curves of a supine or non-supine human body allowing for greater flexibility and comfort in transferring a non-supine patient. Also, while not shown, a single rigid insert or plurality of rigid inserts with a material capable of maintaining a flat position that has a memory, allowing it to roll up for a storage position, may be employed in the patient transfer apparatus.

The plurality of handhold openings 116 pass through the top layer 102, the bottom layer 104, and the rigid inserts 106, 108, 110 and 112. The handhold openings 116 are positioned along the perimeter of the patient transfer apparatus 100 and are preferably between ¼ and 2 inches proximal from the outside perimeter of the apparatus 100. However, the only limitation on the position of handhold openings is that the handhold openings must be positioned at a distance from the perimeter so that an apparatus meets applicable strength requirements or regulations. In the embodiment as shown in FIG. 1, the handhold openings 116 measure between 4 and 6 inches in length and are between 2 and 3 inches in width with a generally rectangular shape with rounded corners. However, this rectangular shape and the length and width is not meant as a limitation as any ergonomic size and/or geometric shape known by one of skill in the art is also within the scope of the invention.

The handhold openings 116 in this embodiment comprise eight equally spaced handhold openings 116 on both lateral sides of the center of each rigid insert 106, 108, 110 and 112 so that four are on each of the two longer sides of the patient transfer apparatus 110. In addition, loops, multiple fabric layers of three or greater, cushion material, grommets, shoulder straps, metal handles, cylindrical plastic, and other materials and devices known by those of skill in the art.

FIG. 11 illustrates a sectional view of a material hinge 1114 as a part of a folding patient transfer apparatus 1100 according to one embodiment of the invention. The material hinge 1114 is created by sewing a material top layer 1102 to a material bottom layer 1104 forming a seam where the seam is positioned between two inserts 110 and 112.

Figure 2:
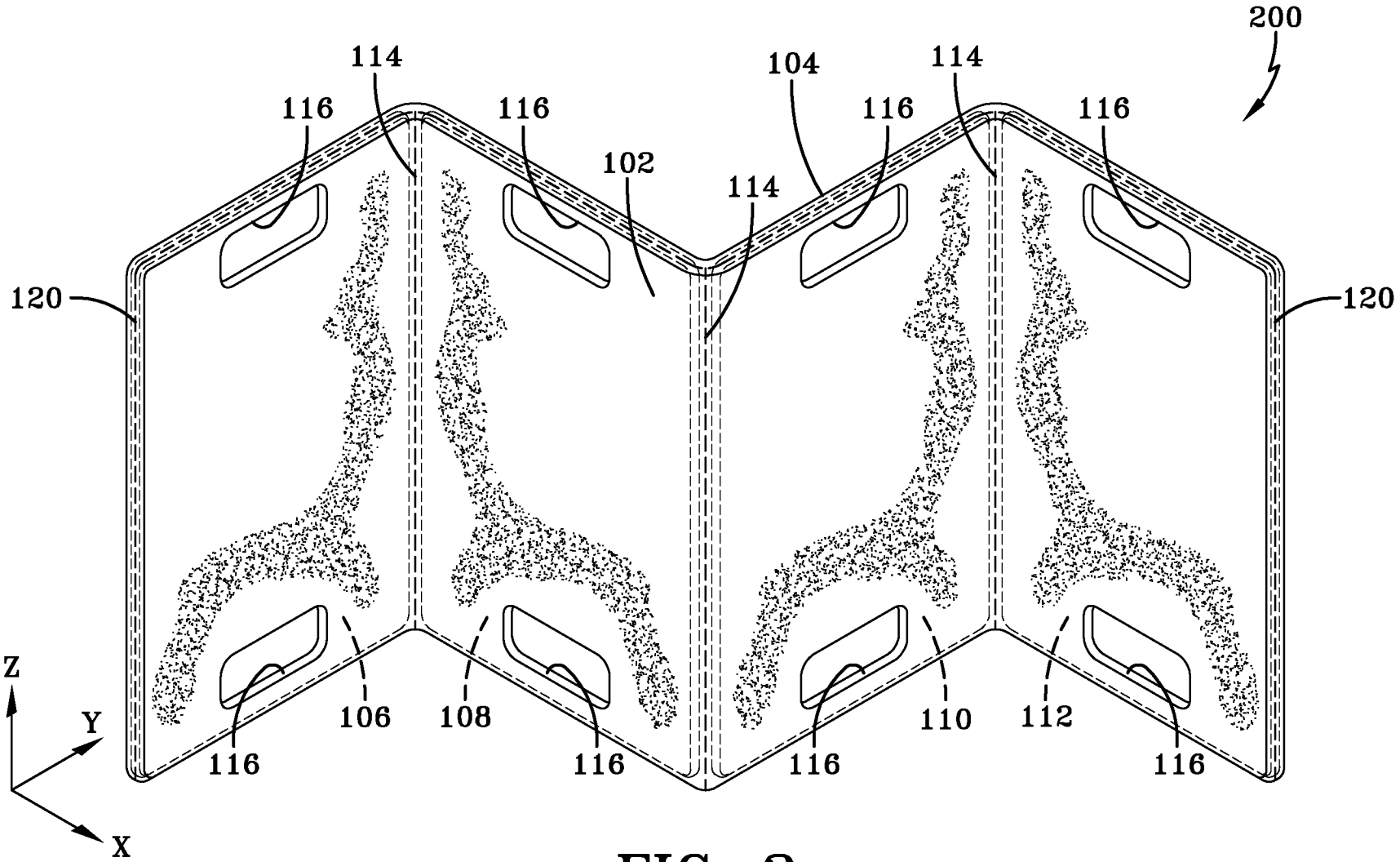
FIG. 2 illustrates a perspective view of a folding patient transfer apparatus where a plurality of material hinges are partially articulated according to another embodiment of the invention.
Figure 3:
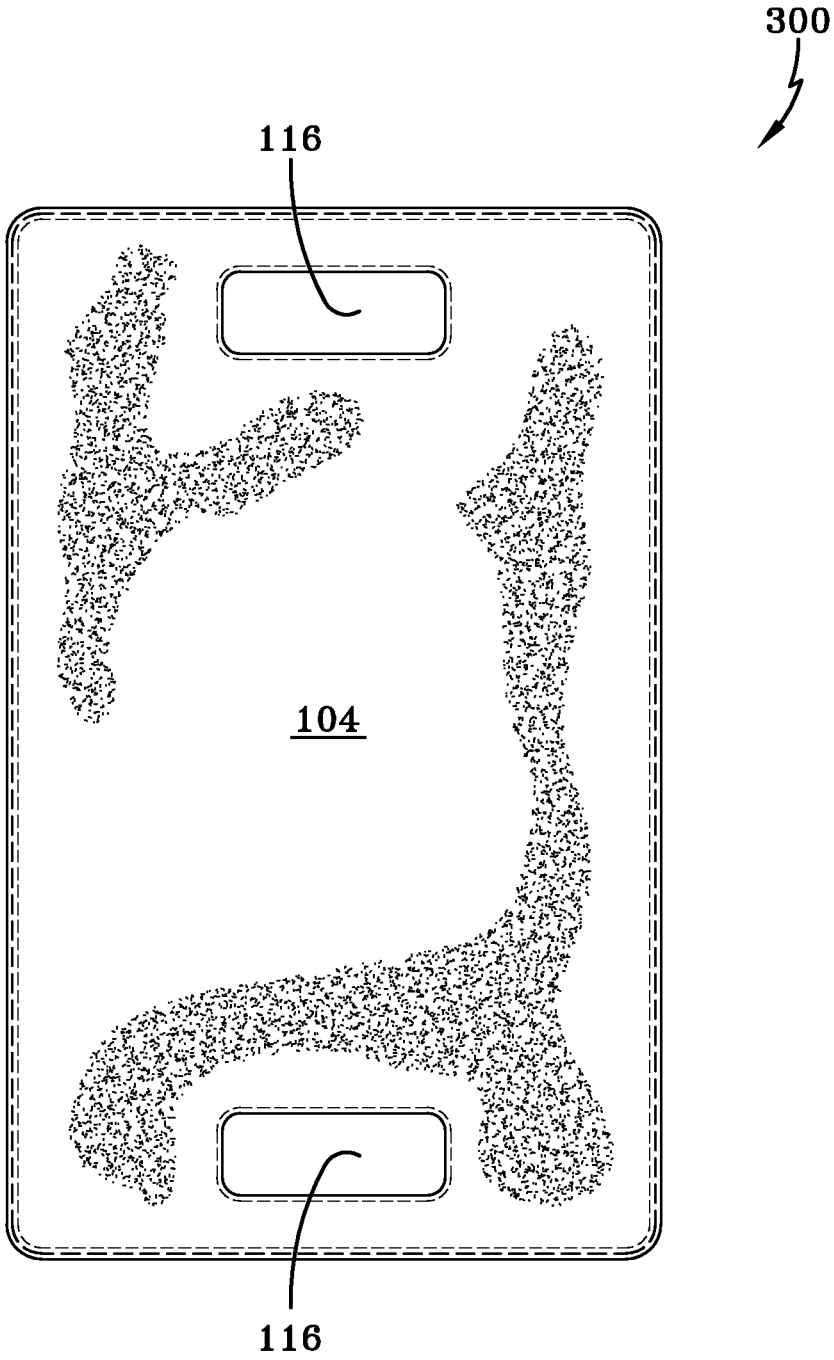
FIG. 3 illustrates a top view of a folding patient transfer apparatus in a fully folded storage position wherein a plurality of handholds align according to yet another embodiment of the invention.

Referring now to FIGS. 2 and 3, the spacing may be such that the plurality of handhold openings 116 on each side can align on top of each other when the patient transfer apparatus 200 is folded for storage along the plurality of hinges 114 to its storage size of approximately one quarter of its total length in the x direction. In FIG. 2 the patient transfer apparatus 200 is shown in a partially closed position. The preferred embodiment has a total of eight equally spaced and identically sized handhold openings 116, with the four handhold openings 116 on each side, the inventor recognized that any number of handhold openings, of any spacing and of different dimensions may be placed around the perimeter of a patient transfer apparatus. In FIG. 3 the fully closed apparatus 300 can be joined together with devices comprising hooks and loops, clips, snaps, straps and the like (not shown).

Figure 4:
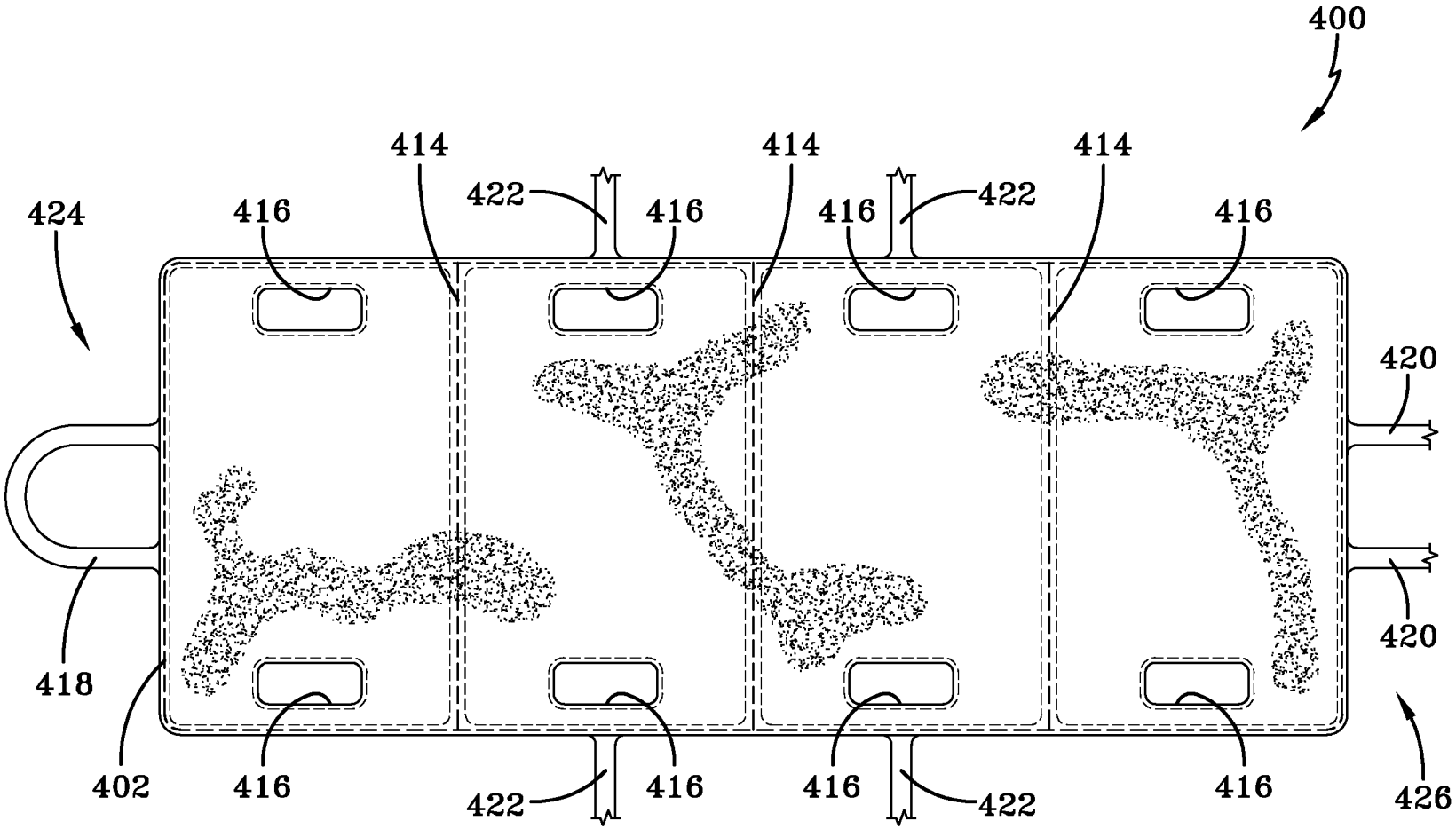
FIG. 4 illustrates a perspective view of a folding patient transfer apparatus according to another embodiment of the invention.

Referring now to FIG. 4, an embodiment of a patient transfer apparatus 400 may further comprise securing a patient to the apparatus 400. This facilitates securing the patient transfer apparatus 400 in a folded or storage position, and expanding the functionality for a variety of transfer scenarios. A pull strap 418 may be fixedly or non-fixedly attached to a head end 424 and/or a foot end 426 of the patient transfer apparatus 400. The pull strap 418 may comprise an integrated continuous loop, two pieces of material, and other types of pull strapping known by one of skill in the art, that are attachable at the ends of the pull strap 418 with devices comprising hooks and loops, clips, snaps, buttons, carabineers, and the like, so that when attached, the two pieces form the pull strap 418. The pull strap 418 may be used to help reposition a patient in place on the patient transfer apparatus 400 who has slid down on a bed or other surface by moving the patient and the device longitudinally along the surface. Another benefit of the pull strap 418 is for use to help drag a non-ambulatory victim out of a hazardous environment comprising a fire or chemical spill by using the patient transfer apparatus 400 as a low friction surface sled to move a patient across a floor or carpet, for example. Once removed from danger, the patient could remain on the patient transfer apparatus 400 for transfer to an ambulance cot, and later to a hospital bed with little disruption to the patient and without the need to move the patient off of the apparatus 400.

The embodiment illustrated in FIG. 4 may further comprise a plurality of storage straps 420 which extend from the head end 424 and/or the foot 426 of the patient transfer apparatus 400 attached in a similar manner as the pull strap 418. The storage straps 420 may be used to secure the patient transfer apparatus 400 when fully compact in a nonuse or storage position where the patient transfer apparatus 400 is folded to approximately one quarter of its deployed or fully extended size. The storage straps 420 may be non-fixedly attached to themselves with devices comprising hooks and loops, clips, buttons, snaps, grommets, seatbelt buckles, and the like, or by any attaching technique known by one skilled in the art.

Next, a plurality of patient straps 422 may extend from the sides of the patient transfer apparatus 400 in a similar manner to the pull strap 418 and the storage straps 420. The patient straps may attach to or extend from any position along the perimeter of the patient transfer apparatus 400 such as extending from a hinge 414 or from the corners for example. The patient straps 422 may be used to secure a patient to the patient transfer apparatus 400 in a horizontal or crisscross fashion. However, the patient straps 422 may also be completely detachable from the patient transfer apparatus 400 so as to not interfere with the ability slide a patient between surfaces. For example, the patient straps 422 may attach to a plurality of handhold openings 416 by using devices comprising clips or by allowing the patient strap 422 to loop through themselves after penetrating the handhold openings 416. The embodiment 400 illustrates four straps; however two, three or more than four straps can be utilized.

Figure 5:
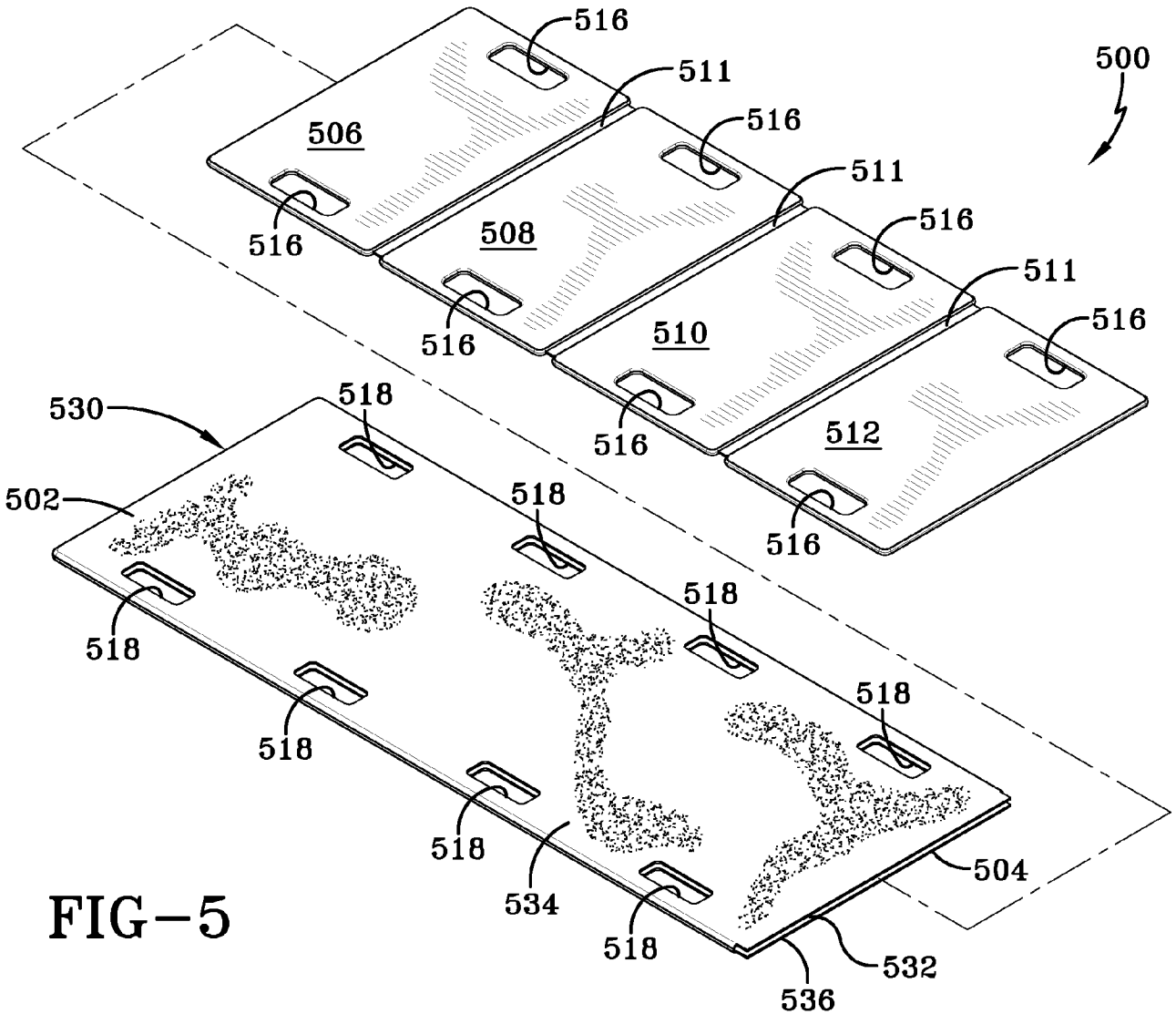
FIG. 5 illustrates a perspective view of a folding patient transfer apparatus with an enclosure according to yet another embodiment of the invention.

Referring now to FIG. 5, another embodiment of a patient transfer apparatus 500 is shown comprising a single rigid or semi rigid apparatus 500. Living hinges 511 can be manufactured using techniques comprising CNC machining, injection molding and other manufacturing techniques known by one of skill in the art. Flexible rigid panels 506, 508, 510 and 512 may be of the same or of different dimensions throughout the patient transfer apparatus 500. Handles 516 are illustrated, for example that are CNC machined or molded into the flexible rigid panels 506, 508, 510 and 512. In this embodiment of the apparatus 500, the apparatus 500 is made from one piece of material. In another embodiment of the apparatus 500, the apparatus 500 can be slid into an enclosure 530 through both the corresponding handles 516 and enclosure handle openings 518 in the enclosure 530 with an upper surface 534 and a lower surface 536. The opening 532 can be closed utilizing devices comprising a continuous plastic zipper, metal and/or plastic interlocking zippers, ultrasonic welding, shrink wrapping, hooks and loops and the like, known by one of skill in the art.

In the apparatus 500, enclosure openings 536 are lined up with the handles 516 and sealed with devices comprising a continuous metal and/or plastic interlocking plastic or metal enclosure half components that are inserted into opposite, ultrasonic welding, shrink wrapping, hooks and loops and the like, known by one of skill in the art.

Figure 6:
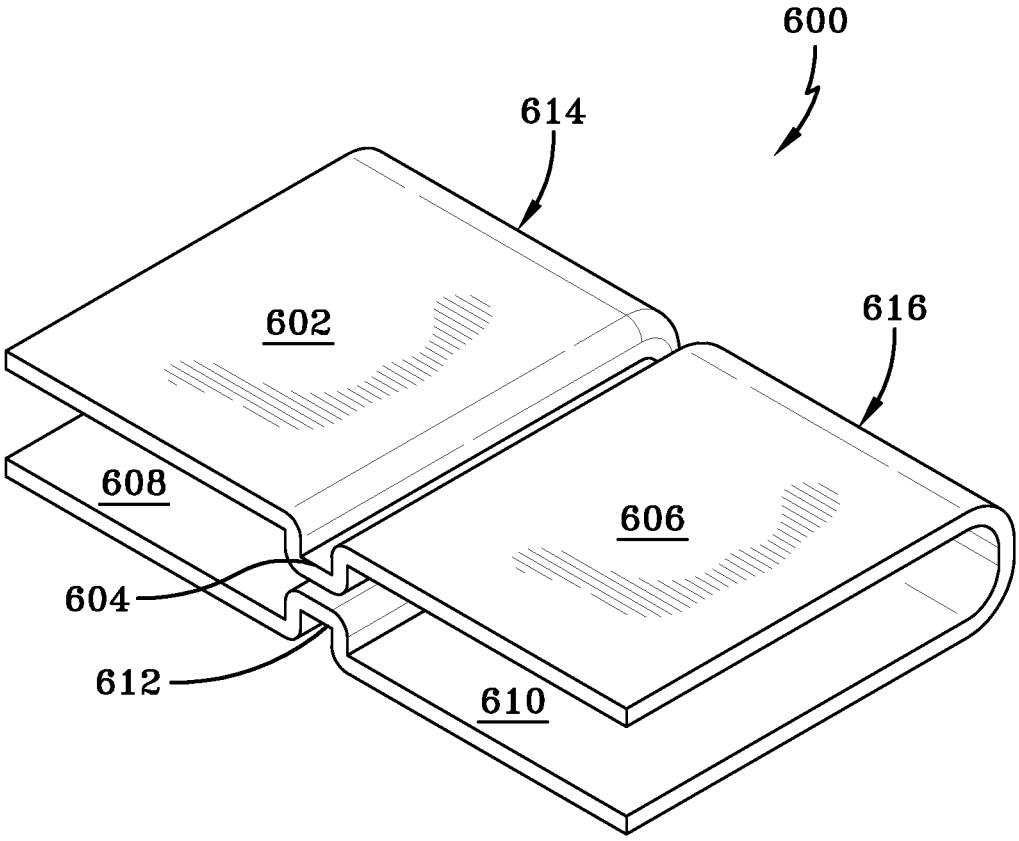
FIG. 6 illustrates a perspective view of an interlocking device according to yet another embodiment of the invention.

An interlocking device 600 illustrated in FIG. 6 that is used to keep adjacent inserts non-fixed locked in the same plane. In addition, the interlocking device 600 adds support and rigidity, for example if the apparatus is used as a flat backer board. The interlocking device 600 comprises upper segments 602 and 606 and lower segments 608 and 610. The upper segments 602 and 606 are connected together by an upper channel 604 and the lower segments 608 and 610 are connected together by a lower channel 612. The first upper segment 602 is connected to the proximate first lower segment 608 by a first rounded back 614. The second upper segment 606 is connected to the proximate second lower segment 610 by a second rounded back 616.

Figure 7:
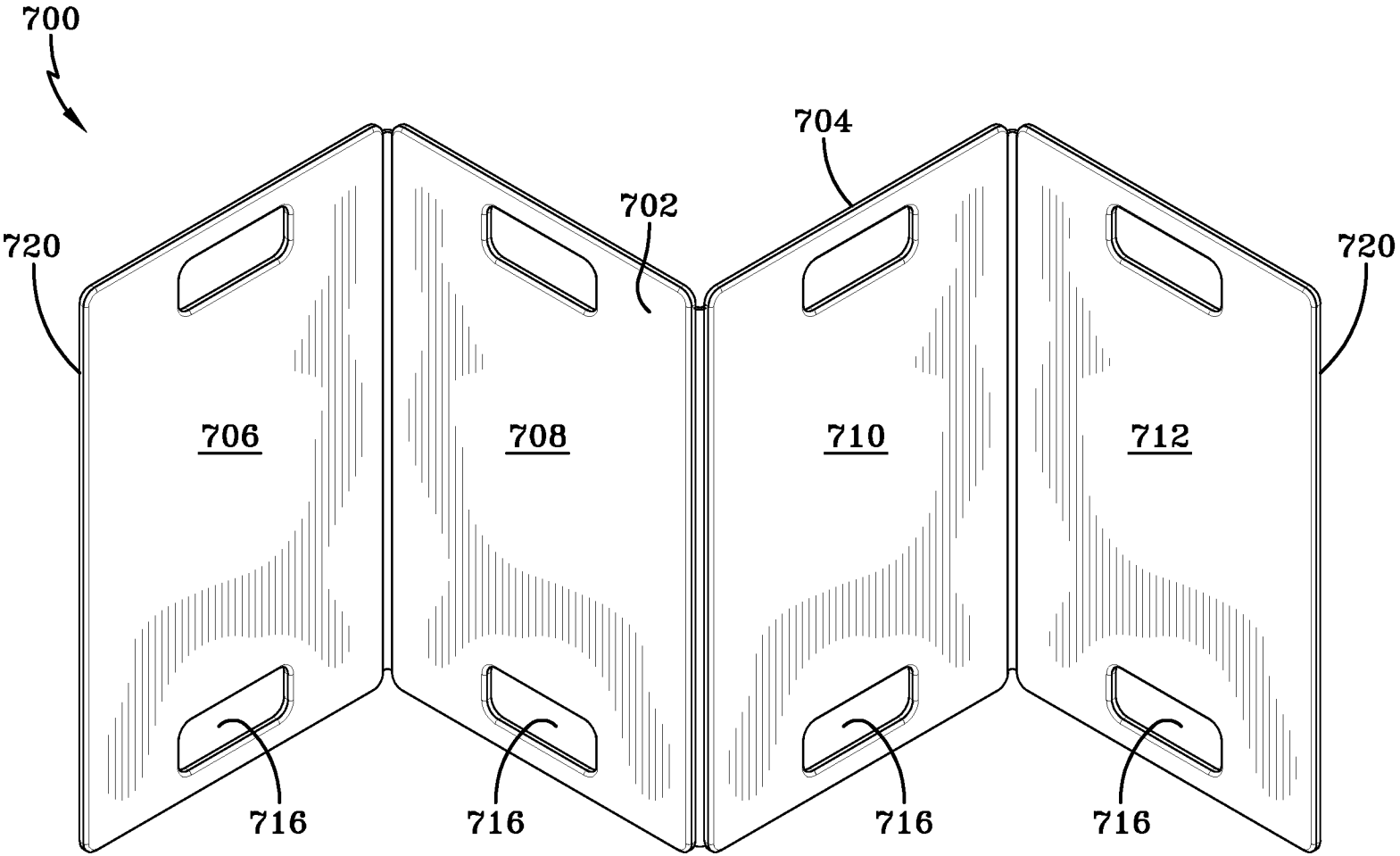
FIG. 7 illustrates a perspective view of a folding patient transfer apparatus where a plurality of living hinges are partially articulated according to another embodiment of the invention.

An apparatus 700 is illustrated in FIG. 7 and is almost identical to the apparatus 200 shown in FIG. 2. The apparatus 700 panels 706, 708, 710 and 712 are connected utilizes living hinges (previously shown and described) that can be manufactured using techniques comprising CNC machining, injection molding and other manufacturing techniques known by one of skill in the art. The apparatus 700 can be utilized with or without the enclosure 530, described in detail supra. The apparatus 700 illustrates a front surface 702 and a rear surface 704 and outer edges 720, with the apparatus in the partially closed position.

Figure 8:
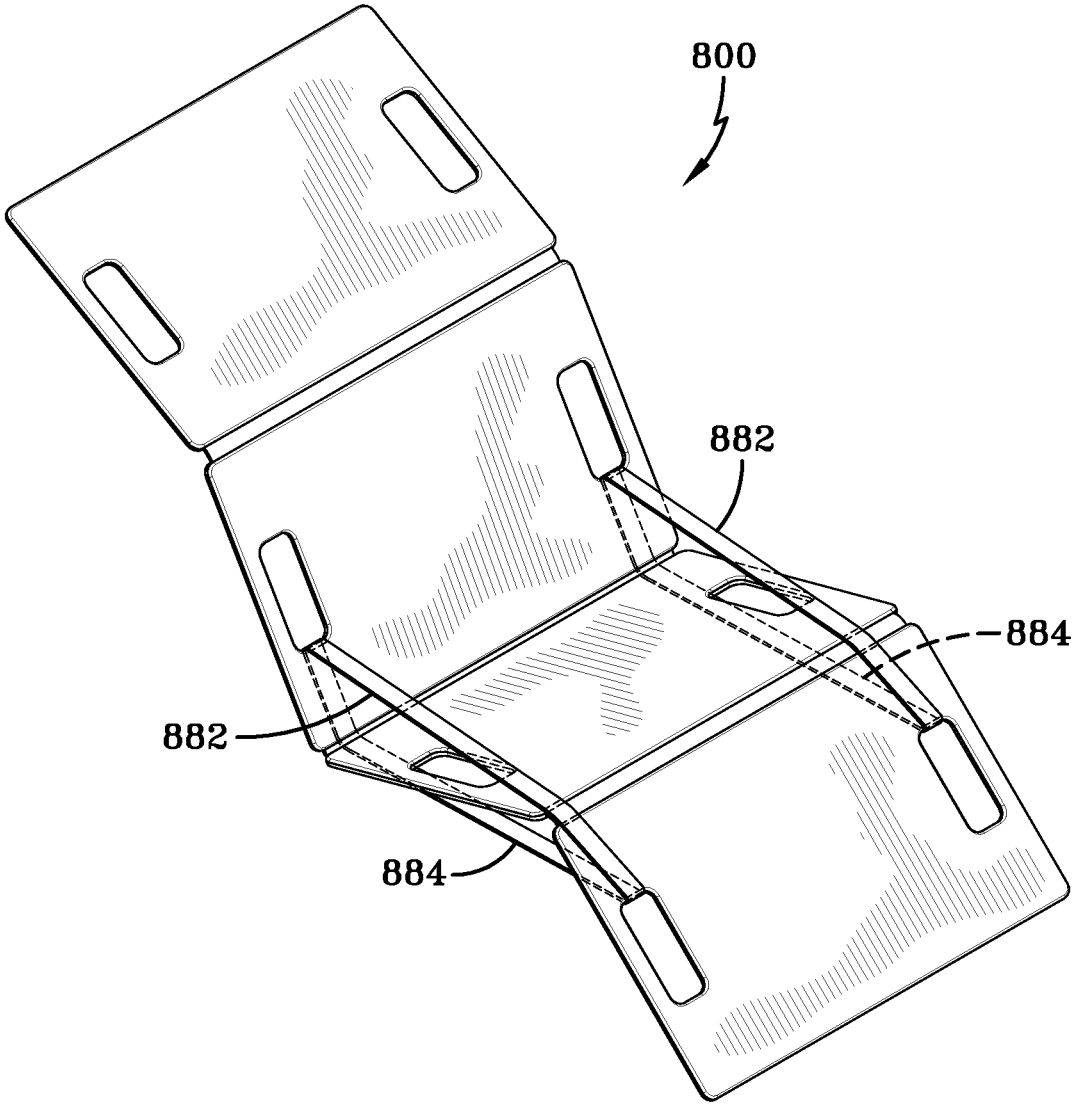
FIG. 8 illustrates a perspective view of a folding patient transfer apparatus with straps according to another embodiment of the invention.

The apparatus 800 illustrated in FIG. 8 is the apparatus 700 shown in FIG. 7 however the apparatus 800 includes straps 882 and 884. The straps 882 and 884 allow the panels 706, 708, 710 and 712 (FIG. 7) to be held securely when the apparatus panels are not planar. The straps 802 can be tightened utilizing devices comprising come-alongs, buckles, seat beat type devices and the like known by one of skill in the art.

Figure 9:
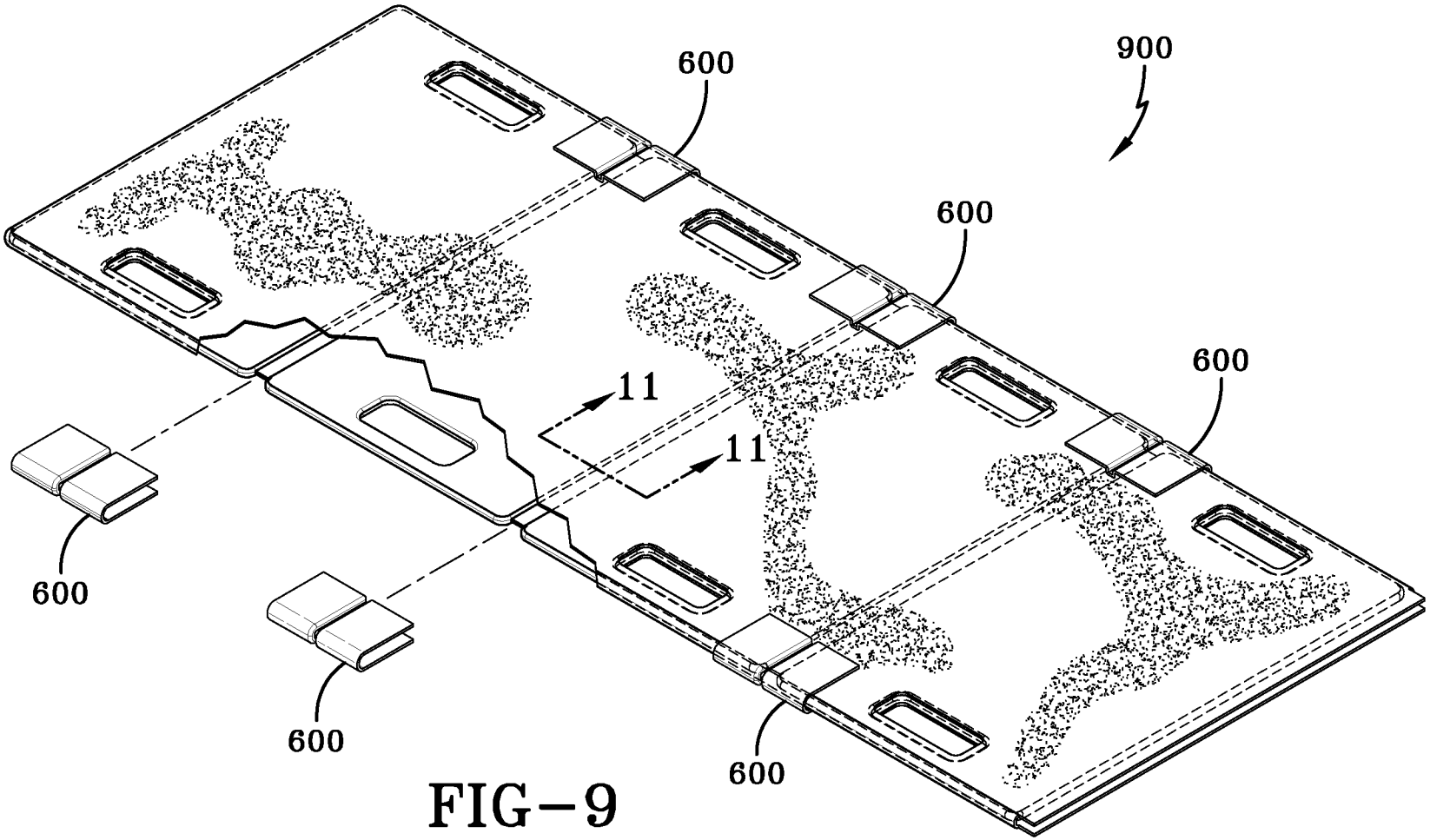
FIG. 9 illustrates a perspective view of a folding patient transfer apparatus on a flat surface with interlocking devices according to one embodiment of the invention.

FIG. 9 illustrates the assembled apparatus 500 in FIG. 5 and the interlocking clamp 600 illustrated in FIG. 6. In order to keep the apparatus 900 planar the clamps 600 are inserted in all of the living hinges with both material top and bottom layers (described previously) at the apparatus edge as shown to keep the apparatus planar.

The clamps 600 can be made of materials comprising polyvinyl chloride (PVC), plastics, polymers, wood, metal, thermoplastics, composites materials, acetyl, resins, laminates and the like.

Figure 10:
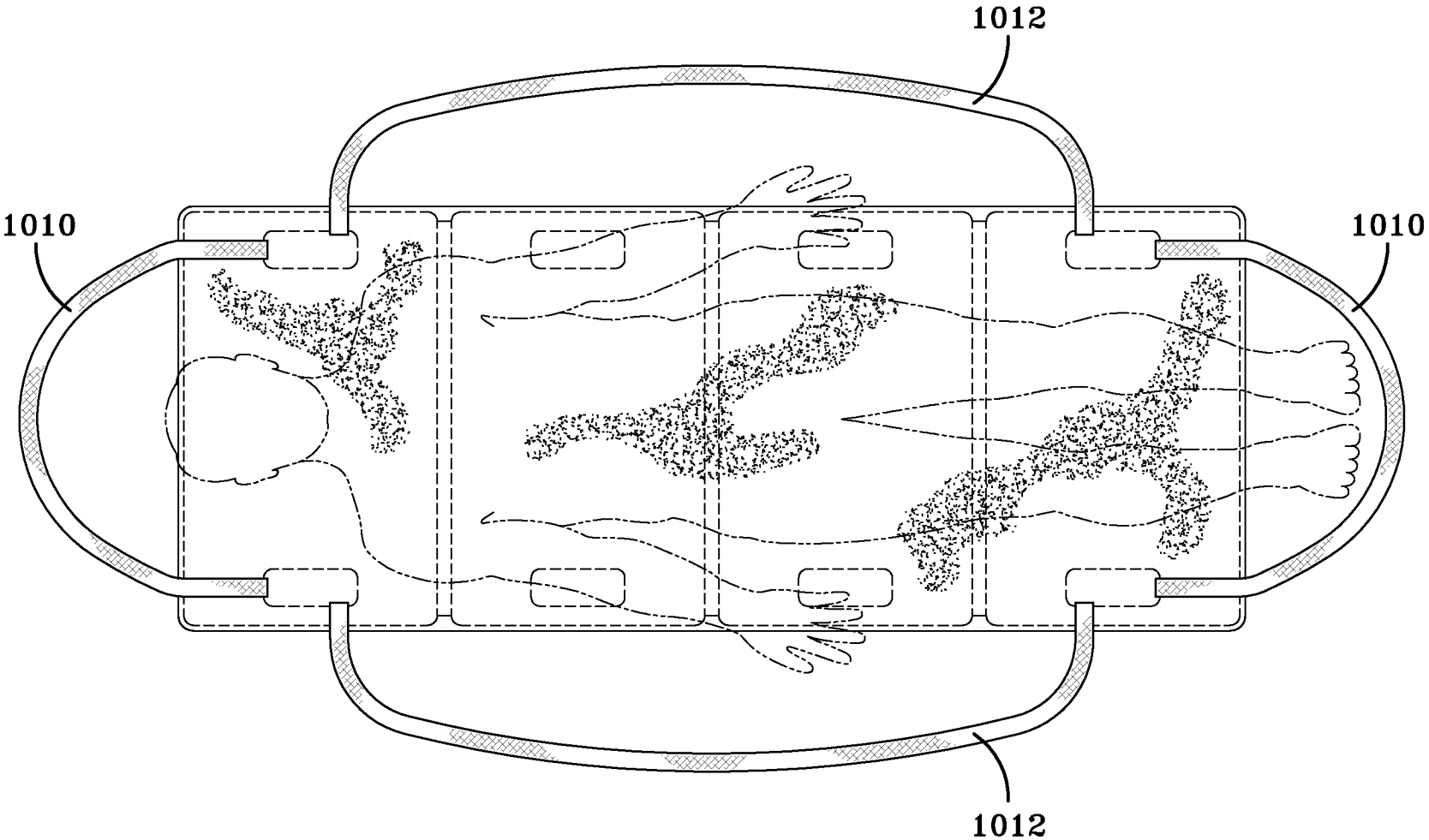
FIG. 10 illustrates a top view of a folding patient transfer apparatus on a flat surface with shoulder straps according to one embodiment of the invention.

FIG. 10 illustrates the apparatus 700 in FIG. 7 with a patient illustrated in phantom lying on the apparatus 700. Clamps (not shown) similar to the interlocking clamp 600 shown in FIG. 6 can be used with the apparatus illustrated in FIG. 10. Two end straps 1010 can be used by the caregivers, for example as shoulder straps to lift and move a patient down a narrow hallway, for example. In another embodiment, EMTs, for example can use side straps 1012 along with lifting with the hands (e.g., in hand holds described previously) if they are in a less confined space. The apparatus 700 can comprise straps of various lengths, numbers, widths and configurations known by one of skill in the art.

Although many of the embodiments described are hermetically sealed, the inventor recognizes a patient transfer apparatus (not shown) where at least the top layer and the bottom layer are joined together on at least one side edge with a detachable closure mechanism such as a zipper, hooks and loops, a sliding snap lock, and the like, or by any other temporary closing method known to one skilled in the art. This detachable closure may permit removal and/or replacement of the rigid inserts individually or in total. Similarly, a disposable outer covering may encase an entire patient transfer device so to assist in lessening contamination to the apparatus. *Clostridium difficile* (C-dif) is a bacterial infection that causes diarrhea, is highly infectious, and is an example of a common hospital acquired infection. It is common for patients to become contaminated in the hospital by C-dif or other infectious agents such as methicillin-resistant *Staphylococcus aureus* (MRSA), when caregivers do not completely decontaminate the transfer equipment. The ability to use a patient transfer apparatus that has a disposable or removable cover for easier sterilization in an autoclave or disposal, for example would be of great benefit in reducing these infections.

Although the invention has been illustrated and described with respect to one or more embodiments, implementations, alterations, and/or modifications may be made to the illustrated examples without departing from the spirit and scope of the appended claims. In particular regard to the various functions performed by the above described components or structures (assemblies, devices, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including". "includes", "having", "has", "with", or variants thereof are used in either the detailed description and the claims, such terms are intended to be inclusive in a manner similar to the term "comprising".

What is claimed is:

1. A folding patient transfer apparatus comprising a material top layer, a material bottom layer, a plurality of inserts, a perimeter seam, and a plurality of handhold openings, a plurality of chambers for receiving the plurality of inserts, and plurality of interlocking devices;

wherein the plurality of inserts are positioned between the material top layer and the material bottom layer, and adjacent inserts are separated along an x-axis by a plurality of insert seams formed along a y-axis; and wherein the plurality of inserts are further encapsulated by the perimeter seam; and wherein the material top layer comprises a top layer outer surface comprising a first coefficient of friction, and the material bottom layer comprises a bottom layer outer surface comprising a second coefficient of friction that is higher than the first coefficient of friction; and wherein the apparatus is configured to transfer a patient from a non-planar surface to a second surface; and wherein the plurality of chambers are formed between the material top layer and the material bottom layer by the plurality of insert seams and the perimeter seam; and wherein the plurality of insert seams between adjacent inserts form a plurality of hinges rotatable approximately 360 degrees along the y-axis; and wherein the hinges are lockable in an approximately planar orientation by positioning the plurality of interlocking devices on the apparatus to bridge the hinges thereby rigidly connecting adjacent inserts.

2. The folding patient transfer apparatus of claim 1, further comprising at least one restraining device for securing the patient to the apparatus, the at least one restraining device comprising: straps, bands or restraints.

3. The folding patient transfer apparatus of claim 1, wherein the apparatus folds up to approximately one quarter of its fully deployed length.

* * * * *